US007410033B2

(12) United States Patent
Veronesi et al.

(10) Patent No.: US 7,410,033 B2
(45) Date of Patent: Aug. 12, 2008

(54) ELECTRICAL CONNECTOR AND RESTRAINING DEVICE FOR USE WITH ELEVATOR BELTS

(75) Inventors: William A. Veronesi, Hartford, CT (US); Richard J. Ericson, Southington, CT (US); Pankaj Kothari, Enfield, CT (US); Paul A. Stucky, Stockton, CA (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/598,402

(22) PCT Filed: Mar. 16, 2004

(86) PCT No.: PCT/US2004/008205

§ 371 (c)(1),
(2), (4) Date: Aug. 28, 2006

(87) PCT Pub. No.: WO2005/095251

PCT Pub. Date: Oct. 13, 2005

(65) Prior Publication Data

US 2007/0173104 A1 Jul. 26, 2007

(51) Int. Cl.
*B66B 7/00* (2006.01)
*H01R 4/24* (2006.01)

(52) U.S. Cl. ..... 187/391; 187/413; 324/240

(58) Field of Classification Search ..... 187/391, 187/413, 247; 324/240, 262, 693, 700; 439/425
See application file for complete search history.

(56) References Cited

U.S. PATENT DOCUMENTS 4,427,940 A 1/1984 Hirama et al.
5,321,356 A * 6/1994 Weischedel ..... 324/262
5,414,353 A * 5/1995 Weischedel ..... 324/232

(Continued)

OTHER PUBLICATIONS

PCT International Search Report for International application No. PCT/US04/08205, mailed May 26, 2005.

(Continued)

*Primary Examiner*—Lincoln Donovan
*Assistant Examiner*—Eduardo Colon-Santana
(74) *Attorney, Agent, or Firm*—Carlson, Gaskey & Olds

(57) ABSTRACT

A device (30) for making electrically conductive contact with at least one tension member in an elevator belt (22) also provides a restraining feature to support loads on the belt. A connector portion (32) is secured to the belt. In one example, the connector portion (32) includes clamping members (40, 42) that are received on opposite sides of the belt. One of the clamping members supports a plurality of electrically conductive connector members (52) that establish electrical contact with selected tension members (24) within the belt (22). A plurality of load transferring members (66) are supported by the other clamping member in one example. A restraining portion (34) is adapted to be secured in a fixed position relative to a selected structure (36) within the elevator system. An opening (38) through the restraining portion (34) allows the belt (22) to pass but prevents the connector portion (32) from moving beyond the restraining portion (34) as the outside dimension of the connector portion (32) is larger than the size of the opening (38). In one example, high temperature resistant materials such as steel or ceramics are used for the restraining portion (34) and the clamping members (40, 42).

20 Claims, 2 Drawing Sheets

U.S. PATENT DOCUMENTS

| | | | | |
|---|---|---|---|---|
| 5,426,362 | A * | 6/1995 | Ninnis | 324/235 |
| 5,453,291 | A * | 9/1995 | Sasahara et al. | 324/240 |
| 5,788,018 | A * | 8/1998 | Mendelsohn et al. | 187/404 |
| 5,804,964 | A * | 9/1998 | Hamelin et al. | 324/242 |
| 5,886,308 | A * | 3/1999 | Ericson et al. | 187/393 |
| 6,223,862 | B1 * | 5/2001 | Barnes | 187/412 |
| 6,318,506 | B1 * | 11/2001 | Marte et al. | 187/373 |
| 6,633,159 | B1 | 10/2003 | Robar et al. | |
| 7,123,030 | B2 * | 10/2006 | Robar et al. | 324/693 |
| 2003/0011483 | A1 | 1/2003 | Lamb et al. | |
| 2004/0026177 | A1 | 2/2004 | Ayano et al. | |

OTHER PUBLICATIONS

PCT Written Opinion of the International Searching Authority for International application No. PCT/US04/08205, mailed May 26, 2005.

PCT International Preliminary Report on Patentability for International application No. PCT/US04/08205, completed Feb. 1, 2006.

* cited by examiner

ELECTRICAL CONNECTOR AND RESTRAINING DEVICE FOR USE WITH ELEVATOR BELTS

FIELD OF THE INVENTION

This invention generally relates to a combined restraint and electrical connector for supporting a load on an elevator belt under certain circumstances and for making a conductive connection with at least one tension member in the elevator belt.

DESCRIPTION OF THE RELATED ART

Elevator systems typically include a load bearing member such as a rope or belt that bears the weight of the car and counterweight and allows the car to be moved as desired within the hoistway. For many years, steel ropes were used. More recently, coated steel belts have been introduced that include a plurality of tension members encased within a jacket. In one example, the tension members are steel cords and the jacket comprises a polyurethane material.

The introduction of such belts provides significant weight and strength advantages compared to traditional steel ropes.

Regardless of the type of load bearing member used, terminations typically secure ends of the rope or belt relative to the building structure, the elevator car or counterweight. Such terminations are well known and adequately secure the ends of the rope or belt under most circumstances. There are situations, however, where supplemental restraints may be required. For example, fire clips are known. Supplemental restraints that are capable of withstanding high temperatures would be useful for such situations.

New belt technologies introduce the need for new supplemental securing techniques. The new belt arrangements also present new challenges for monitoring the load bearing capabilities of the belt assembly over the life of the elevator system. This invention provides the ability to readily and accurately establish an electrically conductive connection with at least one of the tension members to facilitate an electricity-based monitoring technique combined with the ability to secure an end of the belt in a desired position.

SUMMARY OF THE INVENTION

In general terms, this invention is for making an electrical connection with at least one tension member of an elevator load bearing member and providing restraint of an end of the load bearing member.

One example device includes a connector portion having at least one electrical connector member and at least one load transferring member that are each adapted to penetrate through a coating over tension members. The connector portion has an outside dimension that is greater than that of the load bearing member. A restraining portion is adapted to be fixed relative to a structure such as part of the hoistway or the car frame, for example. The restraining portion includes an opening that has an inside dimension larger than the load bearing member but smaller than the outside dimension of the connector portion. The restraining portion allows the load bearing member to pass through but prevents the connector portion from passing through the opening to secure the end of the load bearing member associated with the device.

In one example, the connector portion and the restraining portion are made from heat resistant materials. Steel is used in one example. A ceramic material is used in another example.

In one example, the electrically conductive connector member is a pin that makes electrically conductive contact with a single tension member. In one example, a plurality of such pins are provided to establish individualized electrical contact with each of the tension members. The load transferring member comprises an individual peg that transfers a load from an individual tension member to the clamping member. In one example, at least one load transferring peg is associated with each tension member within the belt.

The various features and advantages of this invention will become apparent to those skilled in the art from the following detailed description of the currently preferred embodiments. The drawings that accompany the detailed description can be briefly described as follows.

DETAILED DESCRIPTION OF THE PREFERRED EMBODIMENTS

Figure 1:
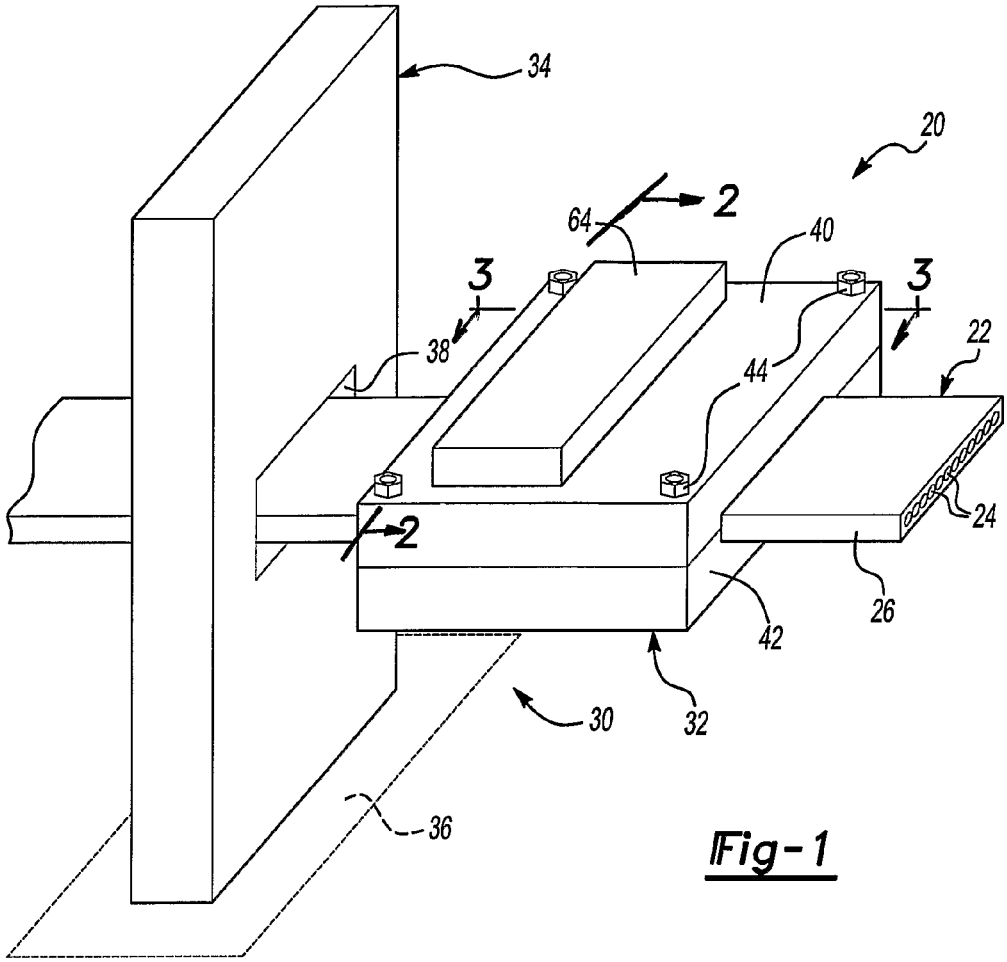
FIG. 1 schematically illustrates an elevator belt to which an example connecting and securing device designed according to an embodiment of this invention is secured.

FIG. 1 schematically shows a connector and restraining device 20 used with an example elevator load bearing member 22. In this example, the load bearing member 22 is a coated steel belt that includes a plurality of tension members 24 that extend along the length of the belt. In one example, the tension members 24 comprise steel cords made up of individual steel strands. A jacket coating 26 surrounds the tension members 24 and provides a generally rectangular cross section for the outside of the belt 22. In one example, the jacket coating 26 comprises a polyurethane material.

The restraining end connecting device 30 includes a first connector portion 32 that is received on the belt 22 and a second restraining portion 34 that is adapted to be fixed in a secured position relative to another structure 36 within a hoistway, for example. In one example, the restraining portion 34 comprises a plate having an opening 38 extending through the plate. The opening 38 preferably has an inside dimension that is greater than an outside dimension of the belt 22 so that the belt can freely move through the opening 38. The size of the opening 38, however, is too small to allow the first portion 32 of the connecting and securing device 30 to pass by the restraining portion 34. In other words, the outside dimension of the first portion 32 is greater than the size of the opening 38. Accordingly, if a load were placed on the belt 22 forcing it toward the left (according to the drawing), the first portion 32 would be received against the restraining portion 34 and the load on the belt 22 would effectively be transferred through the first portion 32 and held by the restraining portion 34 and the associated structure 36.

Under normal conditions, the connector portion 32 is not forced into contact with the restraining portion 34. In one example, a conventional hitch device (not illustrated) is secured to the belt 22 in a known manner so that the portion of the belt shown in FIG. 1 does not bear loads (i.e., is a free end of the belt). The conventional hitch device would be to the left of the restraining portion 34 (according to the illustration).

In one example, the restraining portion 34 is secured to a structural portion of the hoistway. In another example, the restraining portion 34 is secured to an appropriate portion of the elevator car frame assembly. In still another example, the restraining portion 34 is secured to a selected portion of a counterweight. The structure 36 schematically shown in FIG. 1 represents anyone of these.

The first portion 32 establishes an electrical connection and a mechanically secure connection that allows for transferring loads from the belt 22 to the second portion 34. In the illustrated example, the first portion 32 has a first clamping member 40 received on one side of the belt 22 and a second clamping member 42 received on another side of the belt. Securing members 44 secure the first and second clamping members 40, 42 together.

Figure 2:
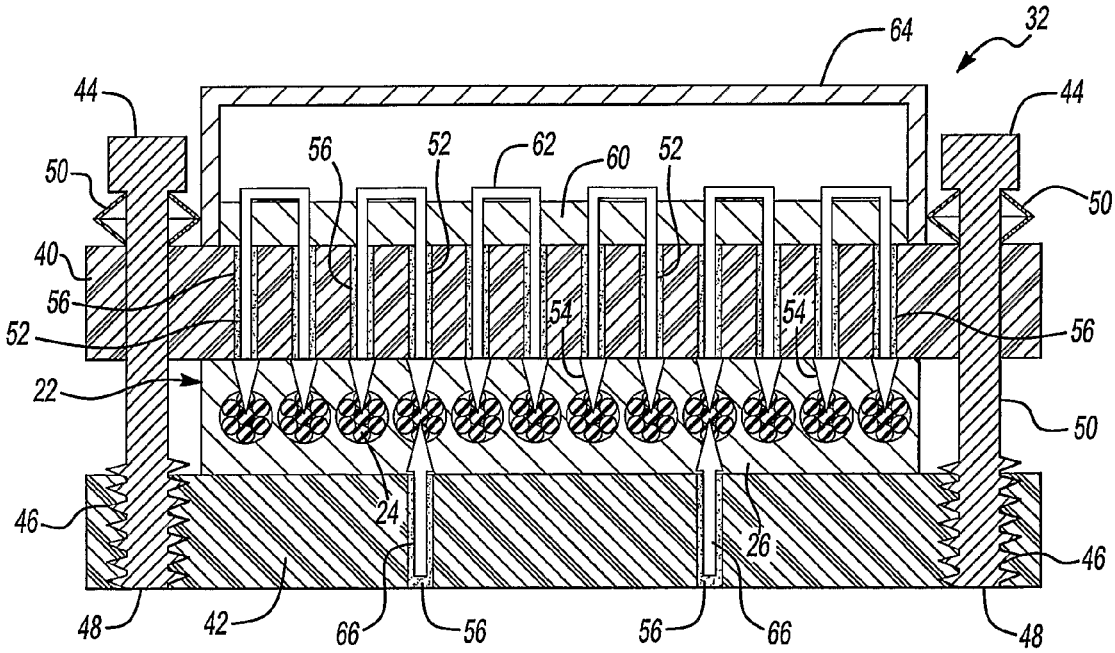
FIG. 2 is a cross-sectional view along the lines 2-2 in FIG. 1.

As best appreciated from FIG. 2, the securing members 44 in this example comprise post members that resemble bolts having threaded ends 46. The second clamping member 42 includes a plurality of threaded openings 48 that receive the threaded ends 46 of the securing members 44. By appropriately manipulating the securing members 44, the clamping members 40 and 42 are drawn against the outer surfaces of the belt 22 to provide a secure attachment.

The illustrated example includes resilient locking members 50 that maintain the desired amount of pressure forcing the clamping members 40 and 42 toward each other. In the illustrated example, the locking members 50 comprise spring washers. In the event that the exterior of the belt 22 becomes deformed, the resilient locking members 50 urge the clamping members 40 and 42 toward each other to accommodate any reduced thickness in the exterior 26 of the belt 22. Such an arrangement allows for more continuous and automatically adjustable pressure on the belt by the clamping members 40 and 42. In one example, the locking members ensure a connection with the tension members 24 even if the jacket 26 melted away in the vicinity of the connector portion 32.

Figure 3:
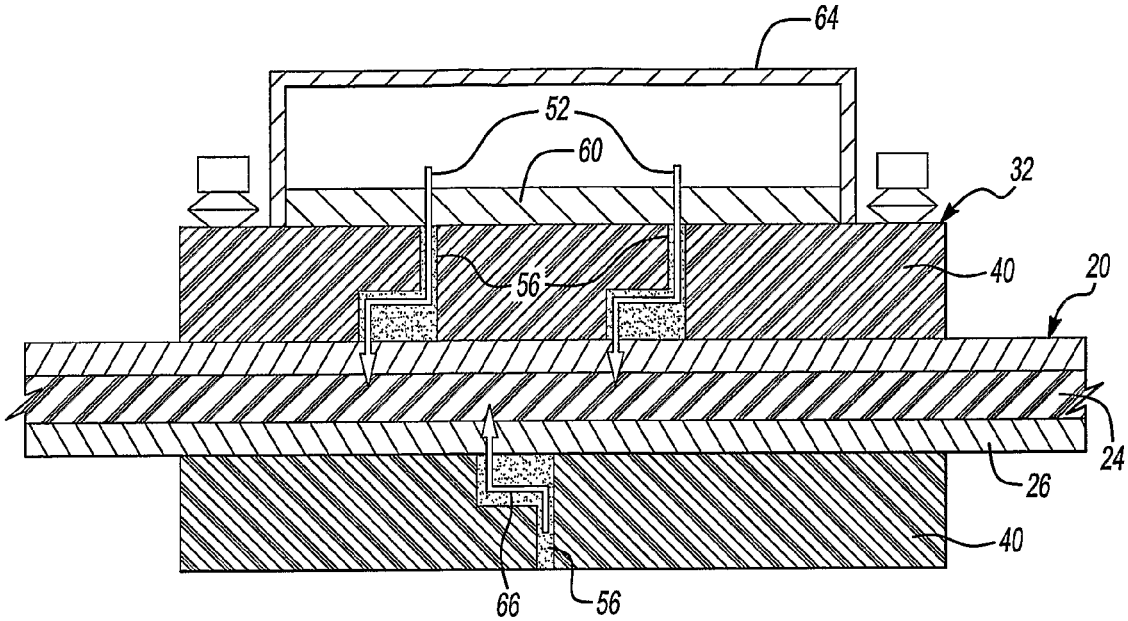
FIG. 3 is a cross-sectional illustration taken along the lines 3-3 in FIG. 1.

As best appreciated from FIGS. 2 and 3, the connector portion 32 includes a plurality of electrically conductive connector members 52. In the illustrated example, the electrically conductive connector members 52 comprise pins that have ends 54 adapted to penetrate through the coating 26 on the belt 22 so that the pins 52 make electrically conductive contact with the tension members 24 in the belt 22. In one example, adjusting the members 44 draws the clamping members 40 and 42 toward each other in a manner that facilitates the ends 54 of the connector members 52 penetrating through the jacket coating 26 to make electrical contact as schematically shown.

In the example of FIGS. 2 and 3, the clamping members 40 and 42 comprise steel or another conductive material. Accordingly, insulating material 56 surrounds the connectors 52 to electrically isolate the connectors from the clamping members.

The illustrated example also includes a printed circuit board 60 having a plurality of circuit traces 62 that establish desired electrical connections between the conductive connector members 52. It is possible with a device designed according to this invention to electrically isolate any one of the tension members 24 or to establish a circuit through any combination of them. The individual connectors 52 facilitate selectively making an isolated connection with each tension member on an individual basis.

In the illustrated example, a housing 64 is supported by the first clamping member 40 to encase the printed circuit board 60 and any electronics supported by that board.

The connector portion 32 also supports a plurality of load transferring members 66, which in this example comprise metallic pegs. Like the electrical connectors 52, the load transferring members 66 are adapted to penetrate through the jacket coating 26 on the belt 22 and make physical contact with the tension members 24. Although not specifically illustrated, in one example, every tension member 24 has at least one load transferring member 66 associated with it.

Because the illustrated example includes electrically conductive load transferring members 66, insulation 56 preferably surrounds them to isolate them from the clamping member 42, which is metallic in this example. The load transferring members 66 preferably do not affect the electrical properties of the tension members 24 in a manner that would interfere with the desired use of the electrical connector members 52 and any electronics or circuitry associated with them.

In the illustrated example, the combination of the electrically conductive connector members 52 and the load transferring members 66 establishes an electrically conductive connection with the tension members 24 while also providing a mechanically secure connection that allows for transferring loads from the tension members to the connector device 32. Accordingly, the inventive arrangement provides a device that serves both functions of establishing an electrical connection with the tension members and a mechanically secure connection that is capable of transferring loads from the tension members to another structure so that the belt 22 can be supported by the same device used to make electrical connections for belt monitoring purposes, for example.

In the illustrated example, bent legs of the connector members 52 and the load transferring members 66 facilitate forcing the pins in if the insulation 56 melted, for example. Having at least a portion of at least some of the members 52 or 66 perpendicular to a direction of insertion into the load bearing member provides a surface against which the clamping member material can act to ensure a proper connection.

Figure 4:
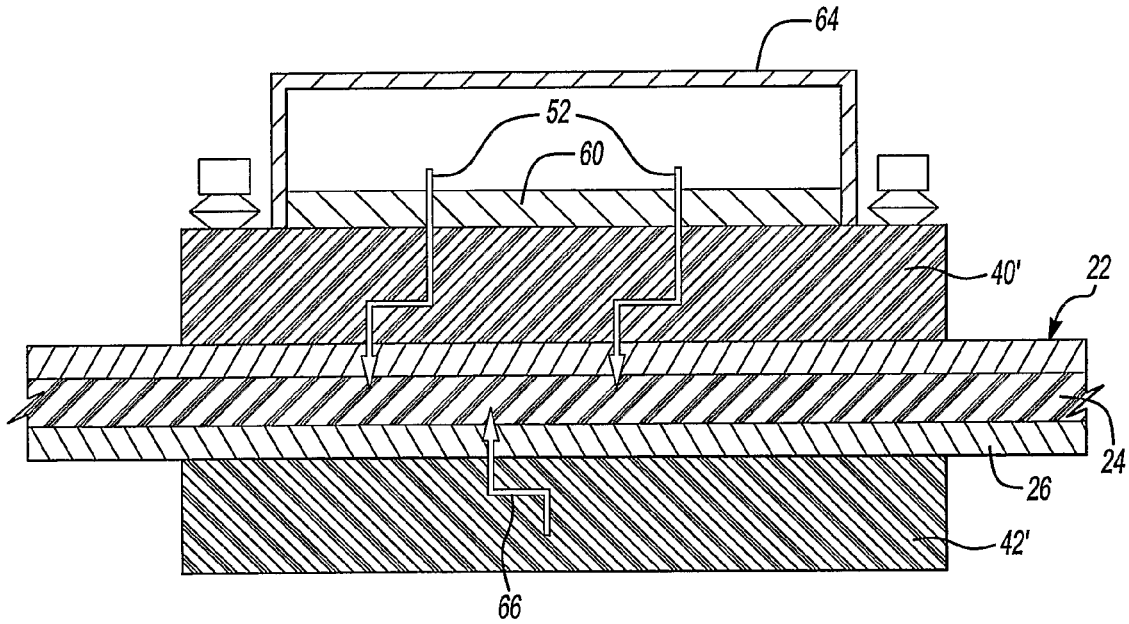
FIG. 4 is a cross-sectional illustration similar to FIG. 3 of another example connector designed according to an embodiment of this invention.

In the example of FIG. 4, the clamping members 40' and 42' are made from a non-metallic, non-electrically conductive material. In this example, no separate insulation layer 56 is required. The material chosen preferably is heat resistant to withstand any extremely high temperatures present in a hoistway or the vicinity of the components of the device 30. In one example a ceramic material is used for the clamping members 40 and 42.

The materials selected for the connector portion 32 and the restraining portion 34 preferably are capable of withstanding high temperatures to provide a supplemental restraint in the event that a primary termination (i.e., a hitch) associated with the belt 22 becomes incapable of appropriately supporting the load on the belt. In one example steel is used for the clamping members of the connector portion 32. In another example a ceramic material is used. Some example restraining portions are made from steel or another metal while others are made from ceramic materials. Given this description, those skilled in the art will be able to select from among commercially available materials to best meet the needs of their particular situation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A device for making electrical contact with at least one tension member in a load bearing member used in an elevator system and for providing a restraining function, comprising:

a connector portion having at least one conductive member that is adapted to penetrate through a coating over at least one tension member and a load transferring member that is adapted to penetrate through a coating over at least one tension member; and a restraining portion having an opening with an inside dimension that is less than an outside dimension of the connector portion such that the portion of the belt associated with the connector portion remains on a selected side of the restraining portion.

2. The device of claim 1, wherein the restraining portion comprises at least one of steel or a ceramic material.

3. The device of claim 2, wherein the restraining portion comprises a plate.

4. The device of claim 1, wherein the connector portion includes a first clamping member supporting the electrically conductive connector member and a second clamping member supporting the load transferring member.

5. The device of claim 4, including a resilient locking member holding the first clamping member and the second clamping member together with a selected amount of tension against the portion of the belt that is received between the clamping members.

6. The device of claim 5, wherein the resilient locking member comprises a threaded member and a spring washer.

7. The device of claim 4, wherein the clamping members comprise an electrically conductive material and including insulation isolating the connector member and the load transferring member from the corresponding clamping members.

8. The device of claim 7, wherein the clamping members comprise steel.

9. The device of claim 4, wherein the clamping members comprise an electrically non-conductive, heat resistant material.

10. The device of claim 9, wherein the clamping members comprise a ceramic material.

11. The device of claim 1, wherein at least one of the conductive member or the load transferring member has a portion aligned generally perpendicular to a direction of penetration into the corresponding tension member.

12. The method of claim 11, wherein the restraining portion comprises at least one of steel or a ceramic material.

13. A method of establishing electrically conductive contact with at least one tension member in a load bearing member used in an elevator system and restraining movement of the load bearing member, comprising the steps of:

securing a restraining portion in a fixed position relative to a selected structure in the elevator system;

forcing at least one electrically conductive connector member at least partially through a coating over the tension member to make an electrically conductive contact between the connector member and the tension member;

forcing a load transferring member at least partially through the coating sufficient to make a mechanically secure contact between a tension member and the load transferring member; and positioning the connector member and the load transferring member on a selected side of the restraining portion such that the associated part of the load bearing member remains on the selected side.

14. The method of claim 13, including supporting the connector member and the tension member within a connector portion that has an outside dimension that is greater than an inside dimension of an opening through the restraining portion.

15. The method of claim 14, wherein the connector portion includes a first clamping member supporting the electrically conductive connector member and a second clamping member supporting the load transferring member.

16. The method of claim 15, including resiliently biasing the clamping members against the belt.

17. The method of claim 15, wherein the clamping members comprise an electrically conductive material and including insulation isolating the connector member and the load transferring member from the corresponding clamping members.

18. The method of claim 15, wherein the clamping members comprise steel.

19. The method of claim 15, wherein the clamping members comprise an electrically non-conductive, heat resistant material.

20. The method of claim 19, wherein the clamping members comprise a ceramic material.

* * * * *